US008514049B2

(12) United States Patent
Sugiyama et al.

(10) Patent No.: US 8,514,049 B2
(45) Date of Patent: Aug. 20, 2013

(54) ELECTRONIC COMPONENT

(75) Inventors: Shinichiro Sugiyama, Kyoto-fu (JP); Kaori Takezawa, Kyoto-fu (JP); Hiromi Miyoshi, Kyoto-fu (JP); Masayuki Yoneda, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/086,251

(22) Filed: Apr. 13, 2011

(65) Prior Publication Data

US 2011/0187486 A1 Aug. 4, 2011

Related U.S. Application Data

(63) Continuation of application No. PCT/JP2009/065909, filed on Sep. 11, 2009.

(30) Foreign Application Priority Data

Oct. 30, 2008 (JP) ..... 2008-279117

(51) Int. Cl.
*H01F 5/00* (2006.01)
*H01F 27/28* (2006.01)

(52) U.S. Cl.
USPC ..... 336/200; 336/222; 336/223

(58) Field of Classification Search
USPC ..... 336/200, 223, 232, 222
See application file for complete search history.

(56) References Cited

U.S. PATENT DOCUMENTS

| | | | | |
|---|---|---|---|---|
| 6,169,470 | B1 * | 1/2001 | Ibata et al. | 336/83 |
| 6,278,602 | B1 * | 8/2001 | Haratani et al. | 361/303 |
| 6,768,409 | B2 * | 7/2004 | Inoue et al. | 336/200 |
| 6,769,159 | B2 * | 8/2004 | Haratani et al. | 29/25.42 |
| 6,894,593 | B2 * | 5/2005 | Reinicke | 335/78 |
| 7,474,191 | B2 * | 1/2009 | Ito et al. | 336/200 |
| 7,928,823 | B2 | 4/2011 | Tatsukawa et al. | |
| 2008/0246579 | A1 * | 10/2008 | Mizuno et al. | 336/205 |
| 2009/0278649 | A1 * | 11/2009 | Tatsukawa et al. | 336/200 |
| 2011/0100527 | A1 | 5/2011 | Tatsukawa et al. | |

FOREIGN PATENT DOCUMENTS

| | | | |
|---|---|---|---|
| JP | 55-091103 | A | 7/1980 |
| JP | 06-050312 | | 7/1994 |
| JP | 10-199729 | A | 7/1998 |
| JP | 2000-252126 | A | 9/2000 |
| JP | 2001-217126 | A | 8/2001 |

(Continued)

OTHER PUBLICATIONS

Korean Office Action issued on Jul. 24, 2012; Korean Patent Application No. 2011-7004696 with English language summary.
International Search Report; PCT/JP2009/065909; Dec. 15, 2009.
Written Opinion of the International Searching Authority; PCT/JP2009/065909; Dec. 15, 2009.
Japanese Office Action "Notification of Reason for Rejection" dated May 15, 2012; Japanese Patent Application No. 2010-535728; with translation.
An Office Action issued by the Korean Intellectual Property Office on Jan. 23, 2013, which corresponds to Korean Patent Application No. 2011-7004696 and is related to U.S. Appl. No. 13/086,251 with English summary.
Japanese Office Action "Notification of Reason for Rejection" dated Mar. 5, 2013 which corresponds to Japanese Patent Application No. 2010-535728 and is related to U.S. Appl. No. 13/086,251 with translation.

*Primary Examiner* — Mohamad Musleh
*Assistant Examiner* — Mangtin Lian
(74) *Attorney, Agent, or Firm* — Studebaker & Brackett PC

(57) ABSTRACT

This disclosure provides an electronic component that can suppress a decrease in the resonant frequency. The electronic component includes a multilayer body having plural insulating layers stacked in a staking direction. Outer electrodes are provided on facing lateral sides of the multilayer body and extend in the stacking direction. Coil conductors are stacked together with the insulating layers to form a coil. The thickness in the stacking direction of at least one of the coil conductors that is directly connected to one of the outer electrodes is smaller than that of the coil conductors that are not directly connected to any of the outer electrodes.

10 Claims, 7 Drawing Sheets

(56) References Cited

FOREIGN PATENT DOCUMENTS

| | | | |
|---|---|---|---|
| JP | 2001-244123 | A | 9/2001 |
| JP | 2002-343640 | A | 11/2002 |
| JP | 2004-342864 | A | 12/2004 |
| JP | 2005-012072 | A | 1/2005 |
| JP | 2005-130242 | A | 5/2005 |
| JP | 2009-176829 | A | 8/2009 |
| KR | 10-0657128 | B1 | 12/2006 |

* cited by examiner

ELECTRONIC COMPONENT

CROSS REFERENCE TO RELATED APPLICATIONS

The present application is a continuation of International Application No. PCT/JP2009/065909, filed Sep. 11, 2009, which claims priority to Japanese Patent Application No. 2008-279117 filed Oct. 30, 2008, the entire contents of each of these applications being incorporated herein by reference in their entirety.

TECHNICAL FIELD

The present invention relates to electronic components, and more particularly, to electronic components including multilayer bodies having built-in coils.

BACKGROUND

As electronic components of the related art, multilayer inductors, for example, a multilayer inductor as disclosed in Japanese Unexamined Patent Application Publication No. 55-91103 (Patent Document 1), are known. In those multilayer inductors, a plurality of insulating layers and plural coil-forming conductor patterns are alternately stacked. The plural coil-forming conductor patterns are connected to each other to form one coil. The coil-forming conductor patterns provided at the uppermost and lowermost positions in the direction in which the insulating layers and the coil-forming conductor patterns are stacked are led out to lateral sides of a multilayer body that is formed of the insulating layers, and are connected to outer electrodes formed on the lateral sides of the multilayer body.

SUMMARY

The present invention provides an electronic component that can suppress a decrease in the resonant frequency.

In one aspect of the disclosure, an electronic component includes a multilayer body having plural insulating layers stacked in a stacking direction, two outer electrodes on respective facing lateral sides of the multilayer body and extending in the stacking direction, and plural coil conductors stacked together with the insulating layers to form a coil. In the above-described electronic component, at least one of the coil conductors is directly connected to one of the outer electrodes and has a thickness in the stacking direction that is smaller than a thickness in the stacking direction of a coil conductor of the plural coil conductors that is not directly connected to one of the outer electrodes.

In another aspect of the disclosure, an electronic component includes a multilayer body having plural insulating layers stacked in a stacking direction, first and second outer electrodes on respective facing lateral sides of the multilayer body and extending in the stacking direction, and plural coil conductors stacked together with the insulating layers to form a coil. In the above-described electronic component, a thickness in the stacking direction of a portion of one of the coil conductors that is directly connected to the first outer electrode, the portion being most adjacent to the second outer electrode, is smaller than the thickness in the stacking direction of one of the plural coil conductors that is not directly connected to the first or second outer electrode.

DETAILED DESCRIPTION

The inventors have realized that in the above-described multilayer inductor, the outer electrodes formed on the lateral sides of the multilayer body and the coil-forming conductor patterns are positioned such that they face each other. Because of this, stray capacitance is generated between the outer electrodes and the coil-forming conductor patterns. Because the resonant frequency of the multilayer inductor is inversely proportional to the square root of the magnitude of stray capacitance, generation of stray capacitance reduces the resonant frequency of the multilayer inductor.

Figure 1:
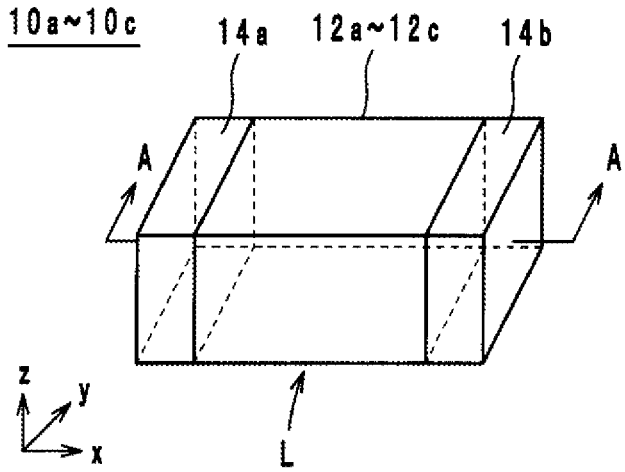
FIG. 1 is a perspective view illustrating electronic components according to exemplary embodiments.
Figure 2:
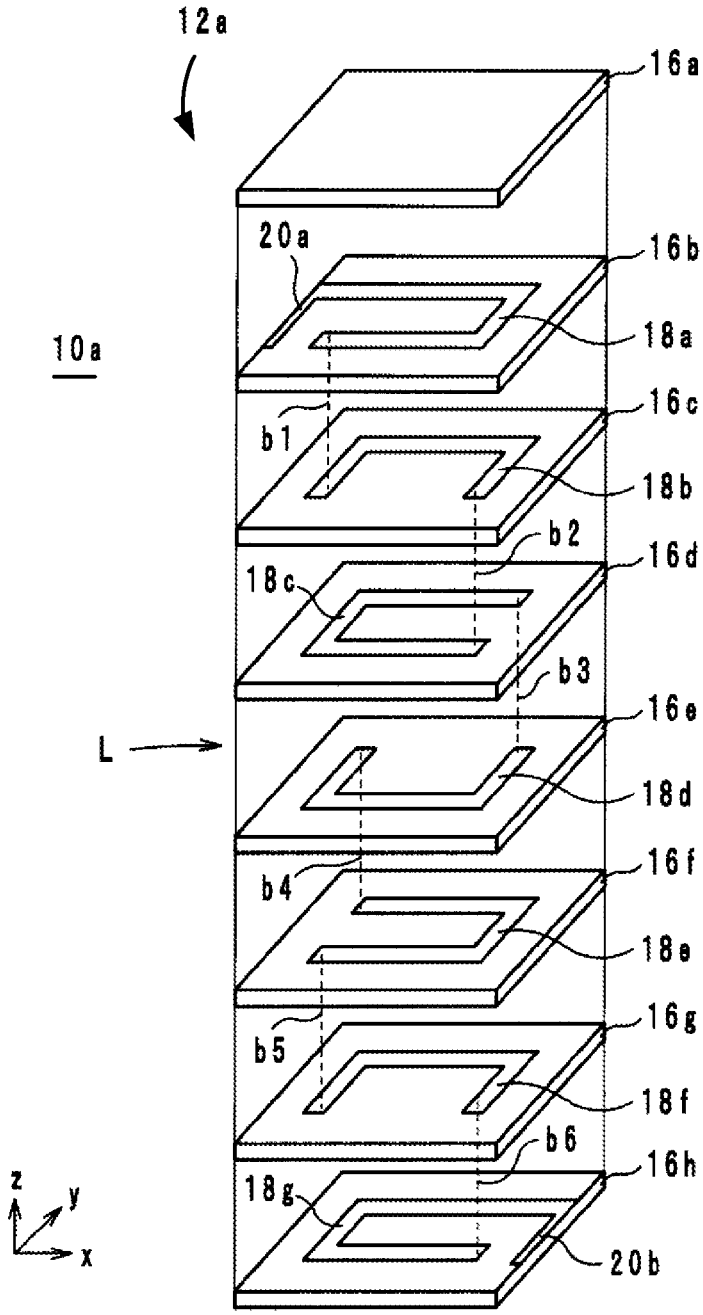
FIG. 2 is an exploded perspective view illustrating a multilayer body of an electronic component according to a first exemplary embodiment.
Figure 3:
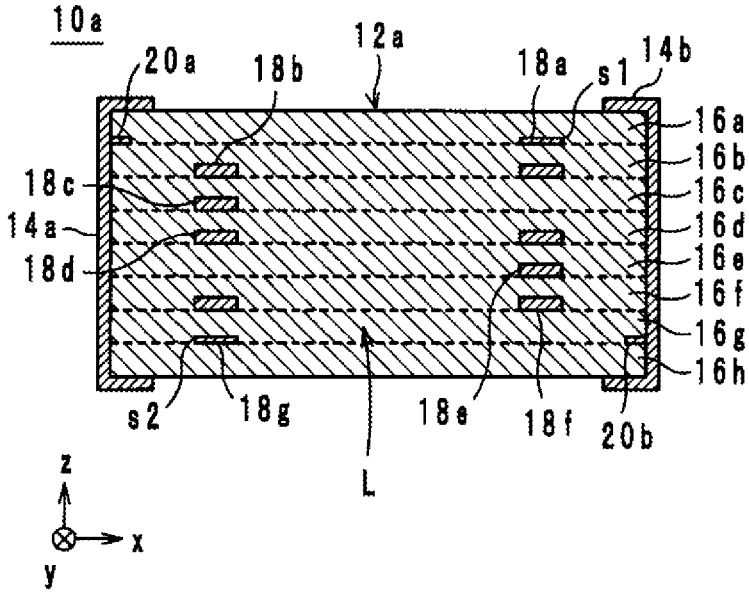
FIG. 3 is a sectional view illustrating the structure of the electronic component taken along line A-A of FIG. 1.

A description will now be given of electronic components according to exemplary embodiments. An electronic component according to a first exemplary embodiment is now described with reference to FIGS. 1 to 3 of the drawings. FIG. 1 is a perspective view illustrating electronic components 10*a* through 10*c* according to the first embodiment, although it also is applicable to other embodiments. FIG. 2 is an exploded perspective view illustrating a multilayer body 12*a* of the electronic component 10*a* according to the first embodiment. FIG. 3 is a sectional view illustrating the structure of the electronic component 10*a* taken along line A-A of FIG. 1. The direction in which layers of the electronic component 10*a* are stacked is hereinafter defined as the z-axis direction, the direction of the long sides of the electronic component 10*a* is hereinafter defined as the x-axis direction, and the direction of the short sides of the electronic component 10*a* is hereinafter defined as the y-axis direction. The x axis, y axis, and z axis are orthogonal to each other.

The electronic component 10*a* includes, as shown in FIG. 1, a multilayer body 12*a* and outer electrodes 14*a* and 14*b*. The multilayer body 12*a* has the shape of a rectangular parallelepiped and has a built-in coil L. The outer electrodes 14*a* and 14*b* are each electrically connected to the coil L, and extend in the z-axis direction. The outer electrodes 14*a* and 14*b* are also provided on the corresponding opposing lateral sides of the multilayer body 12*a*. In this embodiment, the outer electrodes 14*a* and 14*b* are provided such that they cover the two corresponding lateral sides positioned at the ends of the multilayer body 12*a* in the x-axis direction.

The multilayer body 12*a* is configured, as shown in FIG. 2, by stacking insulating layers 16*a* through 16*h* in the z-axis direction. The insulating layers 16*a* through 16*h* are formed of a material made of glass as the main component and have a rectangular shape. Hereinafter, the individual insulating layers 16*a* are referred to by reference numeral 16 along with the corresponding alphabetical characters, and the insulating layers 16 are generically referred to by reference numeral 16 without alphabetical characters.

The coil L, as shown in FIG. 2, is a spiral coil that advances in the z-axis direction while circling, and includes coil conductors 18*a* through 18*g* and via-hole conductors b1 through b6. Hereinafter, the individual coil conductors 18 are referred to by reference numeral 18 along with the corresponding alphabetical characters, and the coil conductors are generically referred to by reference numeral 18 without alphabetical characters.

The coil conductors 18*a* through 18*g* are, as shown in FIG. 2, formed on the principal surfaces of the insulating layers 16*b* through 16*h*, respectively, and are stacked together with the insulating layers 16*a* through 16*h*. Each of the coil conductors 18 is formed of a conductive material made of Ag, and has a length of ¾ of a turn. As shown in FIG. 2, the coil conductor 18*a* provided on the most positive side along the z axis includes a lead-out portion 20*a*, while the coil conductor 18*g* provided on the most negative side along the z axis includes a lead-out portion 20*b*. The coil conductors 18*a* and 18*g* are directly connected to the outer electrodes 14*a* and 14*b* via the lead-out portions 20*a* and 20*b*, respectively. As shown in FIG. 3, the thickness of the coil conductors 18*a* and 18*g* in the z-axis direction, which are directly connected to the outer electrodes 14*a* and 14*b*, respectively, is smaller than that of the coil conductors 18*b* through 18*f*, which are not directly connected to the outer electrode 14*a* or 14*b*. The z-axis thickness of the lead-out portions 20*a* and 20*b* is, as shown in FIG. 3, the same as that of the coil conductors 18*a* and 18*g*.

The via-hole conductors b1 through b6 are formed, as shown in FIG. 2, such that they pass through the insulating layers 16*b* through 16*g* in the z-axis direction. The via-hole conductors b1 through b6 serve the function of connecting, when the insulating layers 16 are stacked, end portions of the coil conductors 18 that are adjacent to each other in the z-axis direction. More specifically, the via-hole conductor b1 connects an end portion of the coil conductor 18*a*, i.e., the end portion without the lead-out portion 20*a*, and the corresponding end portion of the coil conductor 18*b*. The via-hole conductor b2 connects another end portion of the coil conductor 18*b*, i.e., the end portion to which the via-hole conductor b1 is not connected, and the corresponding end portion of the coil conductor 18*c*. The via-hole conductor b3 connects another end portion of the coil conductor 18*c*, i.e., the end portion to which the via-hole conductor b2 is not connected, and the corresponding end portion of the coil conductor 18*d*. The via-hole conductor b4 connects another end portion of the coil conductor 18*d*, i.e., the end portion to which the via-hole conductor b3 is not connected, and the corresponding end portion of the coil conductor 18*e*. The via-hole conductor b5 connects another end portion of the coil conductor 18*e*, i.e., the end portion to which the via-hole conductor b4 is not connected, and the corresponding end portion of the coil conductor 18*f*. The via-hole conductor b6 connects another end portion of the coil conductor 18*f*, i.e., the end portion to which the via-hole conductor b5 is not connected, and an end portion of the coil conductor 18*g*, i.e., the end portion without the lead-out portion 20*b*.

The insulating layers 16*a* through 16*h* formed as described above are stacked such that they are disposed in this alphabetical order from the top to the bottom in the z-axis direction. With this configuration, the coil L that has a coil axis extending in the z-axis direction and that has a spiral structure is formed in the multilayer body 12*a*.

An exemplary manufacturing method for the electronic component 10*a* is described below with reference to the drawings. The exemplary manufacturing method described below is a method for manufacturing a plurality of electronic components 10*a* at one time.

First, a paste-like insulating material is applied onto a film-like base member (not shown), and ultraviolet rays are applied to the entire surface of the base member so that the insulating layer 16*h* is formed. Then, a paste-like conductive material is applied onto the insulating layer 16*h*, and the insulating layer 16*h* is exposed to light and is developed. Thus, the coil conductor 18*g* is formed.

Then, a paste-like insulating material is applied onto the insulating layer 16*h* and the coil conductor 18*g*. The insulating layer 16*h* and the coil conductor 18*g* are further exposed to light and are developed. This results in the formation of the insulating layer 16*g* having a via-hole at the position at which the via-hole conductor b6 is to be formed. Then, a paste-like conductive material is applied onto the insulating layer 16*g*, and the insulating layer 16*g* is exposed to light and is developed. Thus, the coil conductor 18*f* and the via-hole conductor b6 are formed. In this case, the coil conductor 18*f* is formed such that the thickness thereof in the z-axis direction is larger than that of the coil conductor 18*g*. Thereafter, by repeating processes similar to the process of forming the insulating layer 16*g*, the coil conductor 18*f*, and the via-hole conductor b6, the insulating layers 16*c* through 16*f*, the coil conductors 18*b* through 18*e*, and the via-hole conductors b2 through b5 are formed.

After the formation of the coil conductor 18*b* and the via-hole conductor b2, a paste-like insulating material is applied onto the insulating layer 16*c* and the coil conductor 18*b*. The insulating layer 16*c* and the coil conductor 18*b* are further exposed to light and are developed. This results in the formation of the insulating layer 16*b* having a via-hole at the position at which the via-hole conductor b1 is to be formed. Then, a paste-like conductive material is applied onto the insulating layer 16*b*, and the insulating layer 16*b* is exposed to light and is developed. Thus, the coil conductor 18*a*, the lead-out portion 20*a*, and the via-hole conductor b1 are formed. In this case, the coil conductor 18*a* is formed such that the thickness thereof in the z-axis direction is smaller than that of the coil conductors 18*b* through 18*f*.

Then, a paste-like insulating material is applied onto the insulating layer 16*b* and the coil conductor 18*a*, and ultraviolet rays are then applied to the entire surface of the insulating layer 16*b* and the coil conductor 18*a*. Thus, the insulating layer 16*a* is formed. This results in the formation of a mother multilayer product including the plurality of multilayer bodies 12*a*.

Then, the mother multilayer product is press-cut into the individual multilayer bodies 12*a*. Thereafter, the multilayer bodies 12*a* are fired at a predetermined temperature for a predetermined time.

Then, the multilayer bodies 12*a* are polished by using a barrel, and are subjected to edge-rounding and deburring. Also, the lead-out portions 20*a* and 20*b* are exposed from the multilayer bodies 12*a*.

Then, the lateral sides of the multilayer bodies 12*a* are dipped in a silver paste and are baked, so that silver electrodes are formed. Finally, the silver electrodes are plated with Ni, Cu, Zn, etc., thereby forming the outer electrodes 14*a* and 14*b*. Through the above-described process, the formation of the electronic components 10*a* is completed.

The electronic components 10*a* can suppress a decrease in the resonant frequency, as described below. In the multilayer inductor disclosed in Patent Document 1, the outer electrodes formed on the lateral sides of the multilayer body and the coil-forming conductor patterns are positioned such that they face each other in the x-axis direction. This generates stray capacitance between the outer electrodes and the coil-forming conductor patterns. The generation of stray capacitance decreases the resonant frequency of the multilayer inductor.

To address stray capacitance, in the electronic component 10*a* the z-axis thickness of the coil conductors 18*a* and 18*g*, which are directly connected to the outer electrodes 14*a* and 14*b*, respectively, is made smaller than that of the coil conductors 18*b* through 18*f*, which are not directly connected to the outer electrode 14*a* or 14*b*. Among the coil conductors 18*a* through 18*g*, the largest potential difference is generated between the coil conductor 18*a* and the outer electrode 14*b*. Accordingly, the influence of stray capacitance generated between the coil conductor 18*a* and the outer electrode 14*b* on the resonant frequency is greater than that of stray capacitance generated between each of the coil conductors 18*b* through 18*g* and the outer electrode 14*b*. Similarly, among the coil conductors 18*a* through 18*g*, the largest potential difference is generated between the coil conductor 18*g* and the outer electrode 14*a*. Accordingly, the influence of stray capacitance generated between the coil conductor 18*g* and the outer electrode 14*a* on the resonant frequency is greater than that of stray capacitance generated between each of the coil conductors 18*a* through 18*f* and the outer electrodes 14*a*. Thus, in the electronic component 10*a*, the thickness of the coil conductors 18*a* and 18*g* in the z-axis direction is made smaller than that of the coil conductors 18*b* through 18*f*. With this configuration, as shown in FIG. 3, the areas of the lateral sides s1 and s2 of the coil conductors 18*a* and 18*g* facing the outer electrodes 14*b* and 14*a*, respectively, are smaller than the areas of the lateral sides of the other coil conductors 18*b* through 18*f* facing the outer electrode 14*a* or 14*b*. This reduces stray capacitance generated between the coil conductors 18*a* and 18*g* and the outer electrodes 14*b* and 14*a*, respectively. As a result, in the electronic component 10*a*, a decrease in the resonant frequency, which would otherwise be caused by increased stray capacitance, can be effectively suppressed.

The inventors of this application have found through computer simulations that the z-axis thickness of the coil conductors 18*a* and 18*g*, which are directly connected to the outer electrodes 14*a* and 14*b*, respectively, is preferably from ⅓ to ½ the z-axis thickness of the coil conductors 18*b* through 18*f*, which are not directly connected to the outer electrode 14*a* or 14*b*. The computer simulations are described below with reference to the drawings.

Figure 4A:
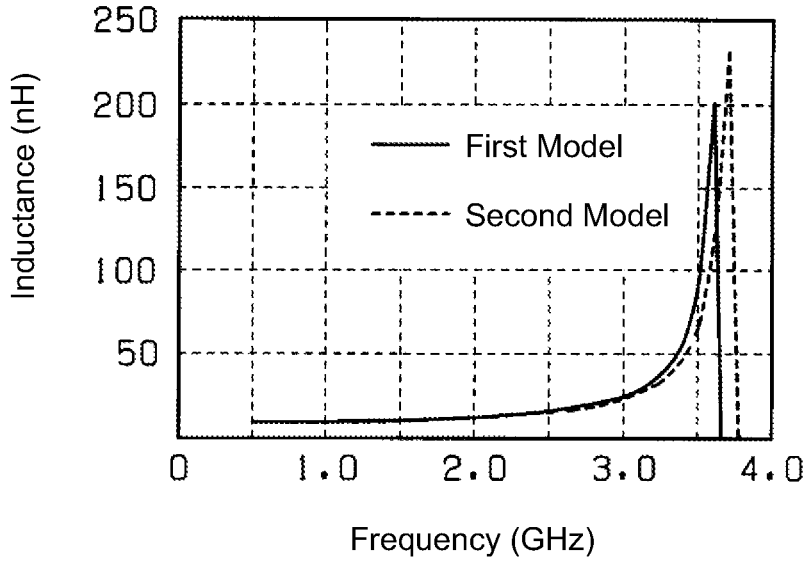
FIGS. 4A and 4B are graphs illustrating simulation results.
Figure 4B:
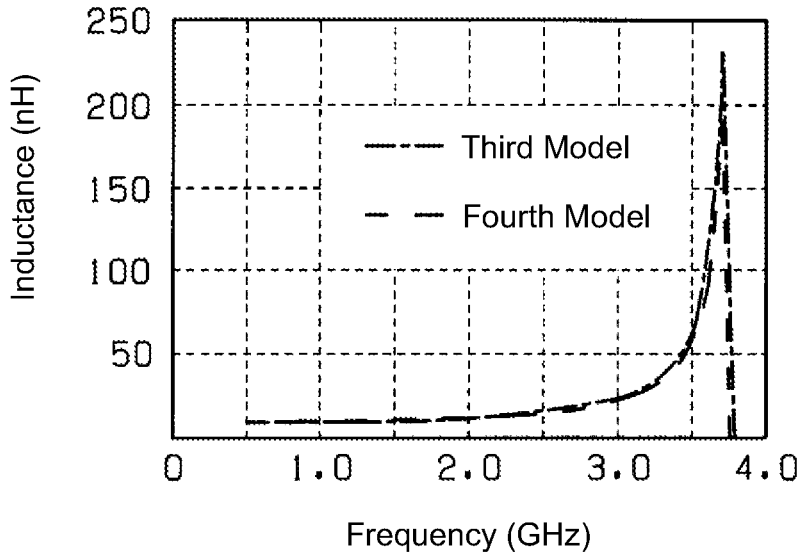

As analytic models, four types of electronic components 10*a* (first through fourth models) were used. In those electronic components 10*a*, the thickness of the coil conductors 18*b* through 18*f* in the z-axis direction was varied. The sizes of the analytic models were 600 μm×300 μm×300 μm. The thickness of the coil conductors 18*b* through 18*f* of the analytic models in the z-axis direction was 15 μm. In the first model, the thickness of the coil conductors 18*a* and 18*g* in the z-axis direction was 15 μm. In the second model, the thickness of the coil conductors 18*a* and 18*g* in the z-axis direction was 7.5 μm. In the third model, the thickness of the coil conductors 18*a* and 18*g* in the z-axis direction was 5.0 μm. In the fourth model, the thickness of the coil conductors 18*a* and 18*g* in the z-axis direction was 3.75 μm. Then, high-frequency signals were input into the first through fourth models, and the relationships between the frequencies and the inductances were examined. FIGS. 4A and 4B show graphs illustrating simulation results. The vertical axis indicates inductance, while the horizontal axis represents frequency.

The simulation results of the first through third models show that, as the thickness of the coil conductors 18*a* and 18*g* in the z-axis direction decreases, the resonant frequency becomes higher and the inductance also increases. That is, when the z-axis thickness of the coil conductors 18*a* and 18*g*, which are directly connected to the outer electrodes 14*a* and 14*b*, respectively, is from ⅓ to ½ the z-axis thickness of the coil conductors 18*b* through 18*f*, which are not directly connected to the outer electrode 14*a* or 14*b*, the resonant frequency becomes higher and the inductance increases.

However, the simulation results of the fourth model show that, although the resonant frequency of the fourth model is substantially the same as that of the second or third model, the inductance with respect to the resonant frequency of the fourth model is smaller than that of the second or third model. This is because of the following reason. The decreased thickness of the coil conductors 18*a* and 18*g* in the z-axis direction increases the resistance of the coils, which further reduces the inductance with respect to the resonant frequency. The above-described computer simulations show that the z-axis thickness of the coil conductors 18*a* and 18*g*, which are directly connected to the outer electrodes 14*a* and 14*b*, respectively, is preferably from ⅓ to ½ the z-axis thickness of the coil conductors 18*b* through 18*f*, which are not directly connected to the outer electrode 14*a* or 14*b*.

Figure 5:
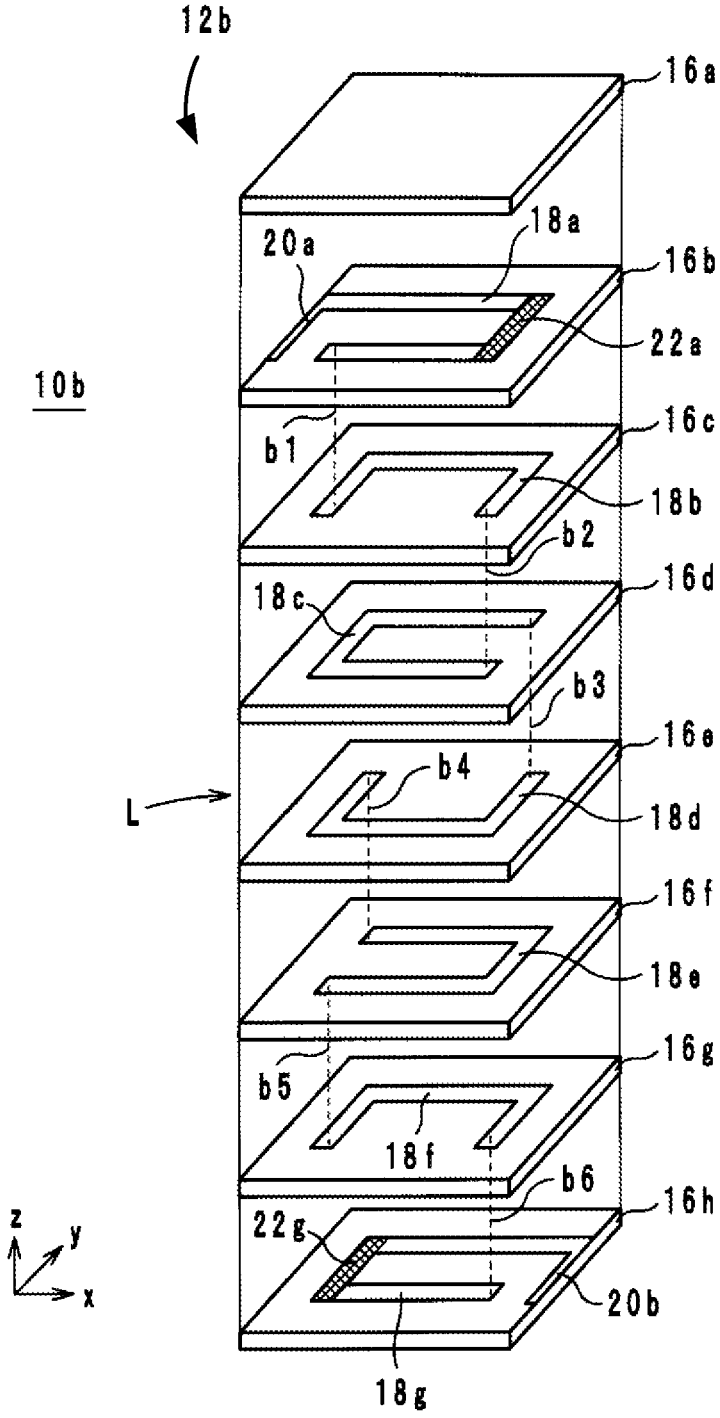
FIG. 5 is an exploded perspective view illustrating a multilayer body of an electronic component according to a second exemplary embodiment.
Figure 6:
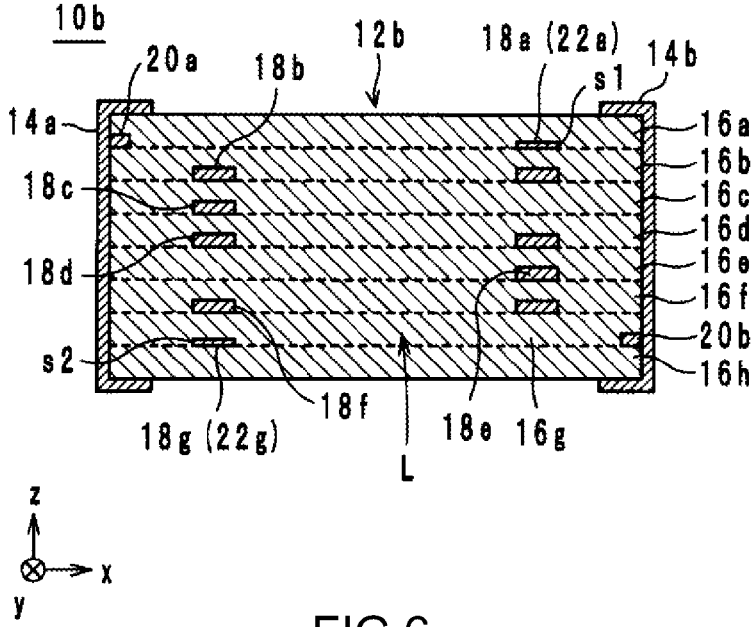
FIG. 6 is a sectional view illustrating the structure of the electronic component according to a second exemplary embodiment taken along line A-A of FIG. 1.

An electronic component according to a second exemplary embodiment is described below with reference to the drawings. FIG. 5 is an exploded perspective view illustrating a multilayer body 12*b* of an electronic component 10*b* according to the second exemplary embodiment. FIG. 6 is a sectional view illustrating the structure of the electronic component 10*b* taken along line A-A of FIG. 1. To illustrate the perspective view of the electronic component 10*b*, FIG. 1 is used. The direction in which layers of the electronic component 10*b* are stacked is hereinafter defined as the z-axis direction, the direction of the long sides of the electronic component 10*b* is hereinafter defined as the x-axis direction, and the direction of the short sides of the electronic component 10*b* is hereinafter defined as the y-axis direction. The x axis, y axis, and z axis are orthogonal to each other.

The electronic component 10*a* and the electronic component 10*b* differ in that the thickness of the coil conductors 18*a* and 18*b* is different in the z-axis direction. More specifically, in the electronic component 10*a*, as shown in FIG. 3, the thickness of the coil conductors 18*a* and 18*g* in the z-axis direction is made smaller than that of the coil conductors 18*b* through 18*f*. On the other hand, in the electronic component 10*b* shown in FIG. 6, the z-axis thickness of only part of the coil conductors 18*a* and 18*g* is made smaller than that of the coil conductors 18*b* through 18*f*. Details thereof are given below.

In the coil conductor 18*a*, the portion that is most susceptible to the generation of stray capacitance with the outer electrode 14*b* is the portion that is most adjacent to the outer electrode 14*b* to which the coil conductor 18*a* is not directly connected (such a portion is hereinafter referred to as an "adjacent portion 22*a*"). More specifically, in the electronic component 10*b*, as shown in FIG. 5, the adjacent portion 22*a* is part of the coil conductor 18*a* that extends parallel to the side of the insulating layer 16*b* on which the outer electrode 14*b* is formed (i.e., the positive side of the x axis). Similarly, in the coil conductor 18*g*, the portion that is most susceptible to the generation of stray capacitance with the outer electrode 14*a* is the portion which is most adjacent to the outer electrode 14*a* to which the coil conductor 18*g* is not directly connected (such a portion is hereinafter referred to as an "adjacent portion 22*g*"). More specifically, in the electronic component 10*b*, as shown in FIG. 5, the adjacent portion 22*g* is part of the coil conductor 18*g* that extends parallel to the side of the insulating layer 16*h* on which the outer electrode 14*a* is formed (i.e., the negative side of the x axis).

In the electronic component 10*b*, therefore, the thickness of the adjacent portions 22*a* and 22*g* in the z-axis direction is made smaller than that of the coil conductors 18*b* through 18*f*, which are not connected to the outer electrode 14*a* or 14*b*. Accordingly, as shown in FIG. 6, the areas of the lateral sides s1 and s2 of the coil conductors 18*a* and 18*g* facing the outer electrodes 14*b* and 14*a*, respectively, are smaller than those of the lateral sides of the other coil conductors 18*b* through 18*f* facing the outer electrode 14*a* or 14*b*. This reduces stray capacitance generated between the coil conductors 18*a* and 18*g* and the outer electrodes 14*b* and 14*a*, respectively. It is thus possible to effectively suppress a decrease in the resonant frequency in the electronic component 10*b*, which would otherwise be caused by increased stray capacitance.

In the electronic component 10*a*, the thickness of the entire coil conductors 18*a* and 18*g* is made smaller. In contrast, in the electronic component 10*b*, the thickness of only the adjacent portions 22*a* and 22*g* of the coil conductors 18*a* and 18*g*, respectively, is made smaller. Accordingly, the resistance of the coil conductors 18*a* and 18*g* of the electronic component 10*b* becomes smaller than that of the electronic component 10*a*. Thus, the direct-current resistance of the coil L in the electronic component 10*b* is smaller than that of the electronic component 10*a*.

The other elements of the configuration of the electronic component 10*b* are the same as those of the electronic component 10*a*, and explanation thereof is given above. The manufacturing method for the electronic component 10*b* is basically the same as that for the electronic component 10*a*, and explanation thereof is given above.

Figure 7:
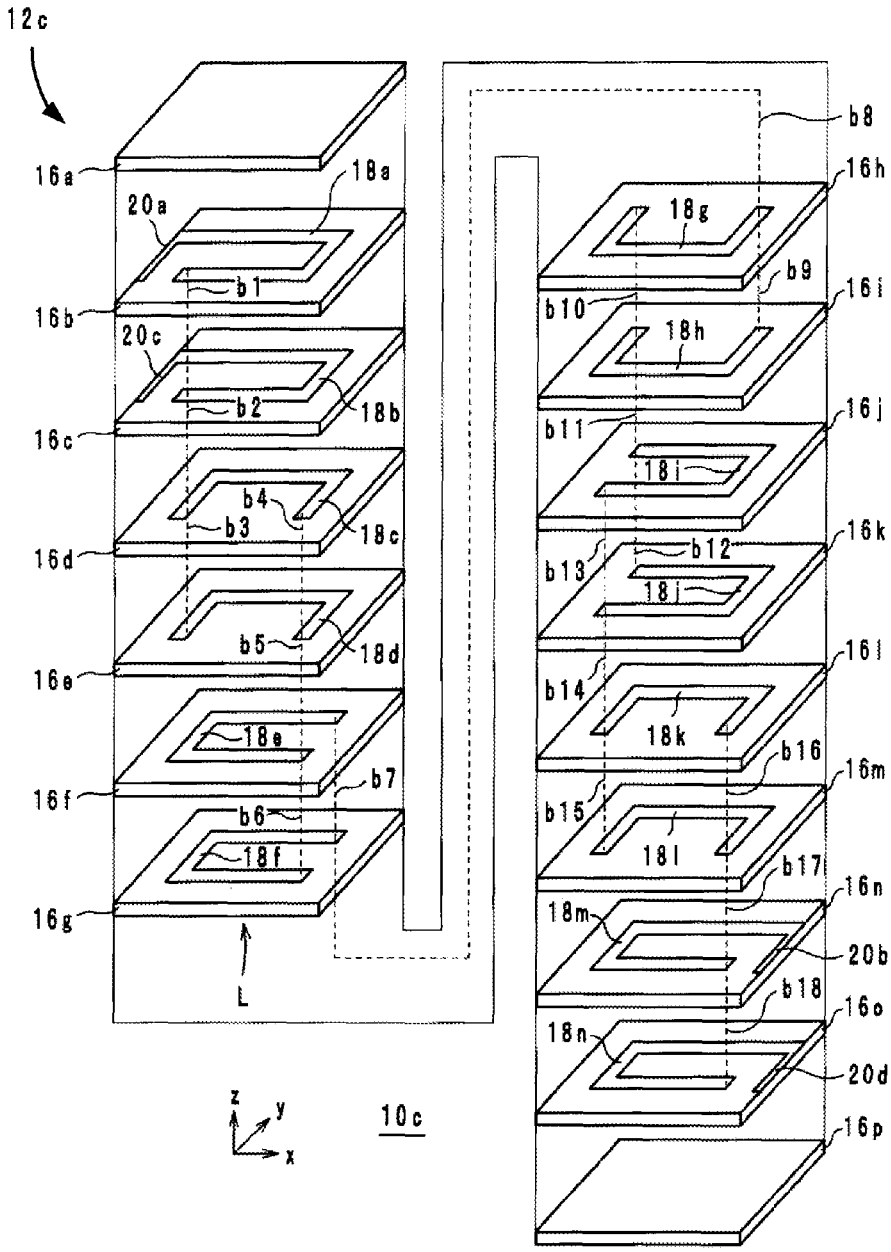
FIG. 7 is an exploded perspective view illustrating a multilayer body of an electronic component according to a third exemplary embodiment.

A description is given below, with reference to the drawings, of an electronic component according to a third exemplary embodiment. FIG. 7 is an exploded perspective view illustrating a multilayer body 12*c* of an electronic component 10*c* according to the third embodiment. To illustrate the perspective view of the electronic component 10*c*, FIG. 1 is used. The direction in which layers of the electronic component 10*c* are stacked is hereinafter defined as the z-axis direction, the direction of the long sides of the electronic component 10*c* is hereinafter defined as the x-axis direction, and the direction of the short sides of the electronic component 10*c* is hereinafter defined as the y-axis direction. The x axis, y axis, and z axis are orthogonal to each other.

The electronic component 10*a* and the electronic component 10*c* differ in the following point. In the electronic component 10*a*, the coil L has a single-spiral structure. In the electronic component 10*c*, however, the coil L has a double-spiral structure. More specifically, in the electronic component 10*c*, coil conductors 18*a*, 18*c*, 18*e*, 18*g*, 18*i*, 18*k*, and 18*m* are connected parallel to coil conductors 18*b*, 18*d*, 18*f*, 18*h*, 18*j*, 18*l*, and 18*n*, respectively, the associated pairs of coil conductors having the same configurations. In the electronic component 10*c* having such a double-spiral structure, the z-axis thickness of the coil conductors 18*a*, 18*b*, 18*m*, and 18*n*, which are directly connected to the corresponding outer electrodes 14*a* and 14*b*, is also made smaller than that of the coil conductors 18*c* through 18*l*, which are not directly connected to the outer electrode 14*a* or 14*b*. With this configuration, a decrease in the resonant frequency can be suppressed.

The other elements of the configuration of the electronic component 10*c* are the same as those of the electronic component 10*a*, and explanation thereof is thus omitted. The manufacturing method for the electronic components 10*c* is basically the same as that for the electronic components 10*a*, and explanation thereof is thus omitted.

The electronic components 10*a* through 10*c* are not restricted to those discussed in the foregoing embodiments, and may be modified. For example, the number of turns of the coil conductors 18 or the number of turns of the coil L is not restricted to that indicated in the foregoing embodiments.

In the multilayer body 12*a* of the electronic component 10*a* shown in FIG. 2, the z-axis thickness of the coil conductors 18*a* and 18*g*, which are directly connected to the outer electrodes 14*a* and 14*b*, respectively, is made smaller than that of the coil conductors 18*b* through 18*f*, which are not directly connected to the outer electrode 14*a* or 14*b*. However, the z-axis thickness of at least one of the coil conductors 18*a* and 18*g* may be made smaller than that of the coil conductors 18*b* through 18*f*, which are not connected to the outer electrode 14*a* or 14*b*. Similarly, in the electronic component 10*b* shown in FIG. 5, the z-axis thickness of at least one of the adjacent portions 22*a* and 22*g* may be made smaller than that of the coil conductors 18*b* through 18*f*.

Embodiments consistent with this disclosure are applicable to electronic components, and are particularly advantageous in the suppression of a decrease in the resonant frequency.

It should be understood that the above-described embodiments are illustrative only and that variations and modifications will be apparent to those skilled in the art without departing from the scope and spirit of the disclosure. The scope of the present invention should be determined in view of the appended claims and their equivalents.

The invention claimed is:

1. An electronic component comprising:

a multilayer body having plural insulating layers stacked in a stacking direction;

two outer electrodes on respective facing lateral sides of the multilayer body and extending in the stacking direction; and plural coil conductors stacked together with the insulating layers to form a coil, wherein at least one of the coil conductors is directly connected to one of the outer electrodes and has a thickness in the stacking direction that is smaller than a thickness in the stacking direction of portion of a coil conductor of the plural coil conductors that is not directly connected to one of the outer electrodes overlapping in the stacking direction with the directly connected coil conductor.

2. The electronic component according to claim 1, wherein the thickness in the stacking direction of at least one of the coil conductors is from ⅓ to ½ the thickness of the coil conductor that is not directly connected to one of the outer electrodes.

3. The electronic component according to claim 1, wherein another one of the plural coil conductors is directly connected to another one of the outer electrodes and has a thickness in the stacking direction that is smaller than the thickness of the coil conductor that is not directly connected to one of the outer electrodes.

4. The electronic component according to claim 1, wherein the entire at least one coil conductor directly connected to one of the outer electrodes has the thickness smaller than a thickness in the stacking direction of one of the plural coil conductors that is not directly connected to one of the outer electrodes.

5. The electronic component according to claim 1, wherein the coil is a double spiral coil.

6. An electronic component comprising:

a multilayer body having plural insulating layers stacked in a stacking direction;

first and second outer electrodes on respective facing lateral sides of the multilayer body and extending in the stacking direction; and plural coil conductors stacked together with the insulating layers to form a coil, wherein the plural coil conductors form a substantially rectangular orbit in the stacking direction, a thickness in the stacking direction of a portion of one of the coil conductors that is directly connected to the first outer electrode, the portion being most adjacent to the second outer electrode and forming a side of the substantially rectangular orbit, is smaller than a thickness in the stacking direction of one of the plural coil conductors that is not directly connected to the first or second outer electrode.

7. The electronic component according to claim 6, wherein the thickness in the stacking direction of at least one of the coil conductors is from ⅓ to ½ the thickness of the coil conductor that is not directly connected to the first or second outer electrode.

8. The electronic component according to claim 6, wherein another one of the plural coil conductors is directly connected to another one of the outer electrodes and has a thickness in the stacking direction that is smaller than the thickness of the coil conductor that is not directly connected to the first or second outer electrode.

9. The electronic component according to claim 6, wherein only the portion being most adjacent to the second outer electrode has the thickness smaller than a thickness in the stacking direction of the plural coil conductor that is not directly connected to the first or second outer electrode.

10. The electronic component according to claim 6, wherein the coil is a double spiral coil.

* * * * *